United States Patent [19]

Tidwell

[11] 4,385,622

[45] May 31, 1983

[54] FIREPLACE LINER INCORPORATING THERMAL EXPANSION STRESS RELIEF SPACERS

[76] Inventor: Joe D. Tidwell, 3513 Brentford Way, Modesto, Calif. 95356

[21] Appl. No.: 289,006

[22] Filed: Jul. 31, 1981

Related U.S. Application Data

[63] Continuation of Ser. No. 111,480, Jan. 11, 1980, abandoned.

[51] Int. Cl.[3] ..... F24B 1/18; F24B 7/00

[52] U.S. Cl. ..... 126/120; 126/121; 126/131; 237/51

[58] Field of Search ..... 126/131, 66, 130, 63, 126/123, 61, 121, 77, 120, 141, 83, 99 B; 237/51; 165/81

[56] References Cited

U.S. PATENT DOCUMENTS

| | | | |
|---|---|---|---|
| 505,237 | 9/1893 | Sheldon | 126/131 |
| 3,438,430 | 4/1969 | Kestemont | 165/81 X |
| 4,004,731 | 1/1977 | Zung | 237/51 |
| 4,026,263 | 5/1977 | Boyd | 126/121 |
| 4,169,458 | 10/1979 | Shaw | 126/121 X |

OTHER PUBLICATIONS

"Majestic, Building Products", Nov. 19, 1959.

*Primary Examiner*—Samuel Scott
*Assistant Examiner*—Randall L. Green
*Attorney, Agent, or Firm*—John J. Leavitt

[57] ABSTRACT

Presented is a fireplace liner fabricated from metal adapted for inclusion in a masonry fireplace structure and which incorporates means for accommodating thermal expansion of the metallic liner so as to preclude the imposition of destructive forces on the surrounding masonry.

3 Claims, 5 Drawing Figures

FIREPLACE LINER INCORPORATING THERMAL EXPANSION STRESS RELIEF SPACERS

This is a continuation, of application Ser. No. 111,480, filed Jan. 11, 1980, now abandoned.

BACKGROUND OF THE INVENTION

1. Field of the Invention

This invention relates to fireplaces, and particularly to the metallic liner within a fireplace structure, commonly known as the firebox.

2. Description of the Prior Art

It is believed the art relating to this invention may be found in Class 126, sub-classes 120, 121, 130, 131 and 141. A search through this field of search has revealed the following U.S. Pat. Nos.: 1,306,612, 1,714,955, 2,494,527, 2,642,859, 2,703,567, 3,180,332, 3,995,611, 4,056,091, 4,013,059.

As indicated by the patents listed above, it appears that metal fireplace liners or fireboxes have been manufactured for many years. Initially, fireplaces were and still are in some instances fabricated from natural stone. In years past, the fireplace served primarily a utilitarian function in that it was used as a source of heat for cooking meals and for heating the residence. With the advent of the wood burning cook stove, the fireplace was not relied upon as extensively for the purpose of cooking, but it continued to be of importance with regard to heating the home. As technology advanced, however, other devices that worked more efficiently for heating the home were developed and the fireplace lost its primarily utilitarian function and became more of an aesthetic feature in the home.

Within the last decade, and perhaps even beyond, there has been a tendency to resurrect the utilitarian features of a fireplace so that it can again be used efficiently as a source of heat for heating the home. In most instances, it is not relied upon as the only source of heat, but it does provide an important adjunct to other more sophisticated and more costly sources of heat. To effectuate this end, fireboxes have been prefabricated which may be utilized as the fireplace liner within fireplace structures that are fabricated in many different styles and from many different materials. The most prevalent practice is to utilize fireproof or non-combustible materials as the fireplace structure to surround the firebox in such a manner as to thermally insulate the firebox from other combustible materials such as wood framing adjacent to the fireplace structure.

In many such fireplaces constructed from masonry products, such as cinder block, cement block, common red brick and other types of masonry products, a concrete pad is poured to support the fireplace structure. On the fireplace pad there is appropriately positioned the metallic firebox which in some instances is lined interiorly with fire brick. Around the outside of the firebox, and around at least a portion of the flu connected to the firebox for drawing products of combustion from the firebox, the masonry fireplace structure itself is usually constructed by skilled stone masons. The usual practice is to abut the masonry material contiguously against the outside surface of the metal firebox, so as to lend mechanical support to the firebox and to thermally insulate it from surrounding combustible materials.

One of the disadvantages of this practice is that the thermal coefficient of expansion and contraction of the heavy metallic firebox differ substantially from the thermal coefficient of expansion and contraction of the masonry products that surround it. The result is that when the metal is heated and expands against the non-elastic masonry, cracks are formed in the surrounding masonry structure that not only weaken the fireplace structure, but permit moisture to enter such cracks, especially if the crack is exposed on an exterior wall, and in any event, renders an otherwise attractive fireplace structure unsightly. Accordingly, it is one of the principal objects of the present invention to provide a fireplace structure, including a firebox, in which means are provided accommodating thermal expansion and contraction of the metallic firebox without imposing destructive forces on the surrounding masonry structure.

Prefabricated fireboxes for fireplaces are sometimes constructed with an inner liner and an outer liner spaced apart to provide an air space through which air may be channelled to increase the efficiency of the fireplace in heating the home. Most such conventional prefabricated fireboxes are constructed in such a manner that the inner liner is rigidly attached to the outer liner by gusset plates that are spot welded to both the inner and outer liner, thus precluding accommodation of differences in thermal expansion and contraction between the two liners and the surrounding masonry wall. Such a construction possess the same disadvantage as the construction discussed above in which the fireplace liner is surrounded directly by masonry, in that the outer liner is heated, expands and imposes a thermally induced tensile stress on the surrounding masonry. Accordingly, it is another object of the present invention to provide a prefabricated firebox for a fireplace structure in which the firebox is constructed to possess an inner liner and an outer liner and means are provided disposed between the two liners to accommodate different rates of expansion and contraction therebetween.

The invention possesses other objects and features of advantage, some of which, with the foregoing, will be apparent from the following description and the drawings. It is to be understood however that the invention is not limited to the embodiment illustrated and described, since it may be embodied in various forms within the scope of the appended claims.

SUMMARY OF THE INVENTION

In terms of broad inclusion, the prefabricated firebox and fireplace construction of the invention comprises a firebox constituting a liner formed from heavy metal plate and adapted to be inserted into a prefabricated galvanized sheet metal outer housing or liner that isolates the inner metal fireplace liner from surrounding masonry. Means are interposed between the inner liner and the surrounding galvanized sheet metal liner to accommodate varying degrees of thermal expansion and contraction between the inner and outer liners. To render the fireplace more efficient, means are also provided for circulating air either from the interior of the room or from outdoors through the space between the inner and outer liners and discharging such heated air into the room as an adjunct to a more conventional heating system.

DESCRIPTION OF THE PREFERRED EMBODIMENT

Figure 1:
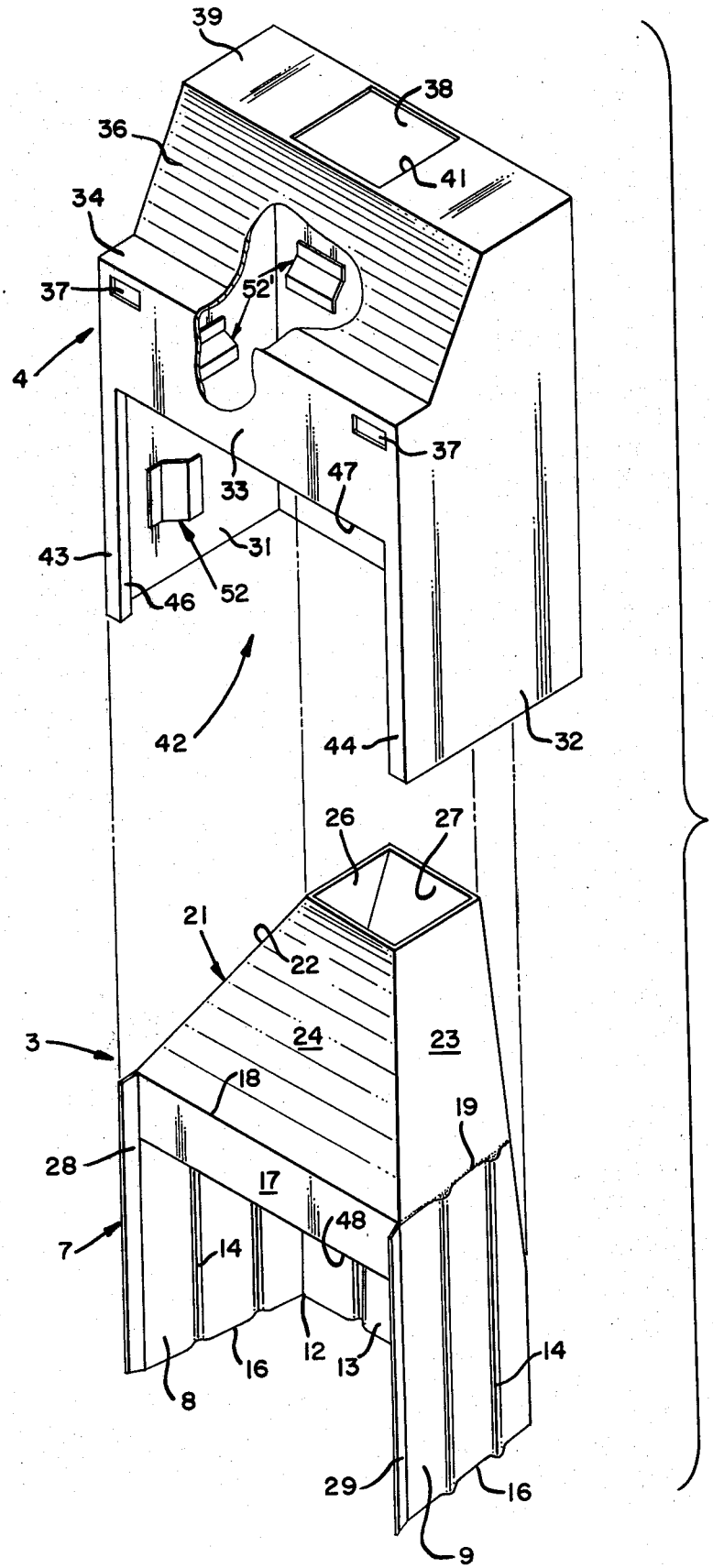
FIG. 1 is a vertical exploded view in perspective of the inner and outer liners forming the firebox of the invention.
Figure 3:
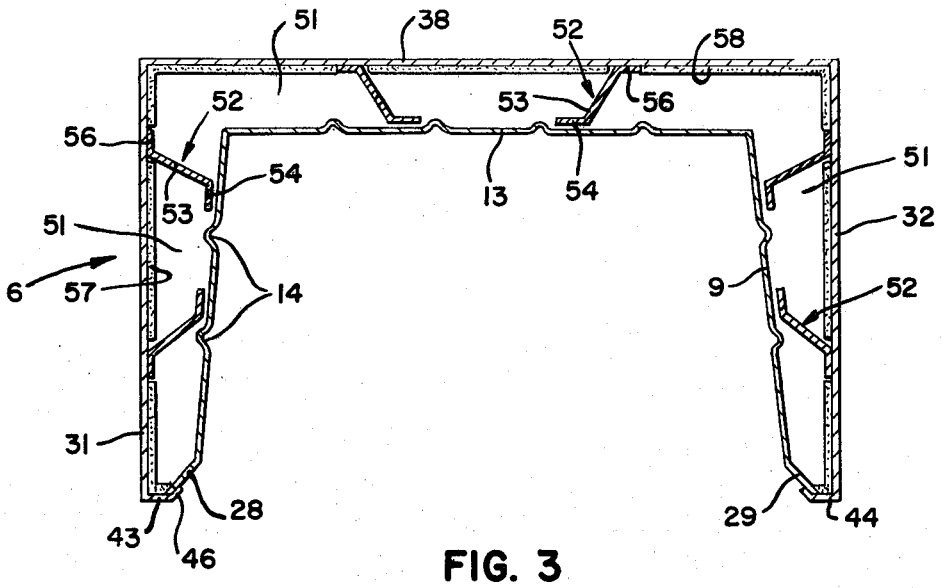
FIG. 3 is a horizontal cross-sectional view taken in the plane indicated by the line 3—3 in FIG. 2.
Figure 2:
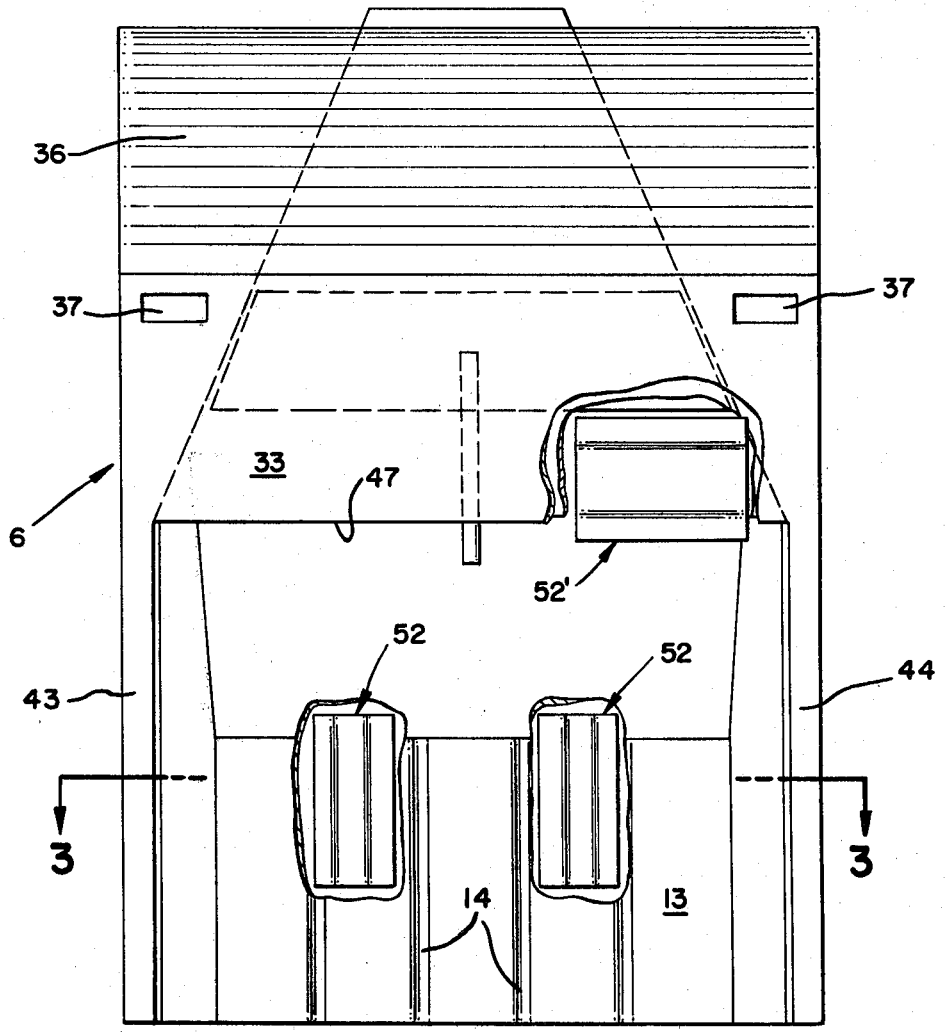
FIG. 2 is a front elevational view of the firebox including both inner and outer liners in assembled form, with portions broken away to illustrate the means of accommodating thermal expansion and contraction between the two liners.
Figure 4:
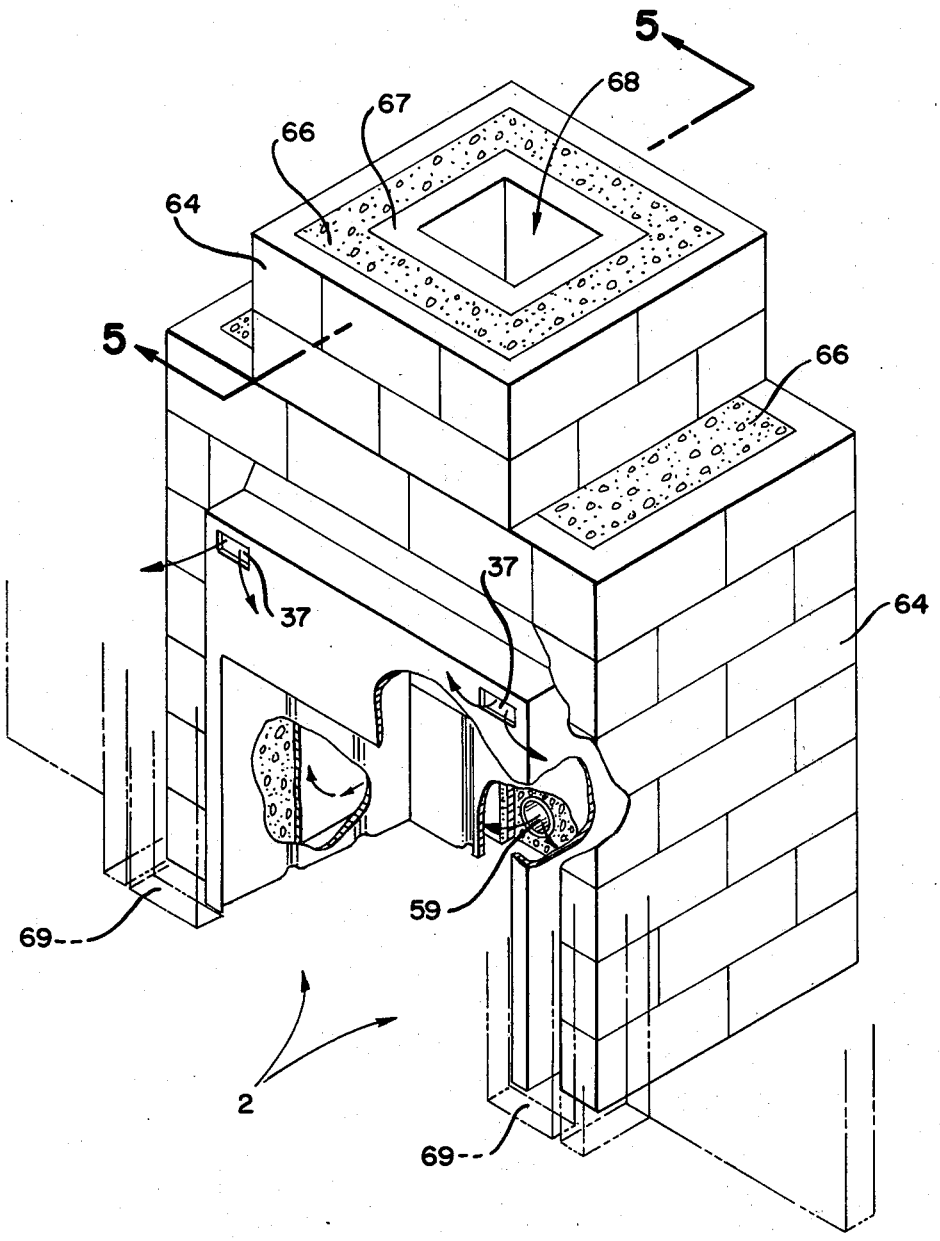
FIG. 4 is a perspective view illustrating the firebox of FIG. 2 incorporated into a masonry fireplace structure, and illustrating the manner in which air is drawn from outdoors into the space between the inner and outer liners and discharged into the room.
Figure 5:
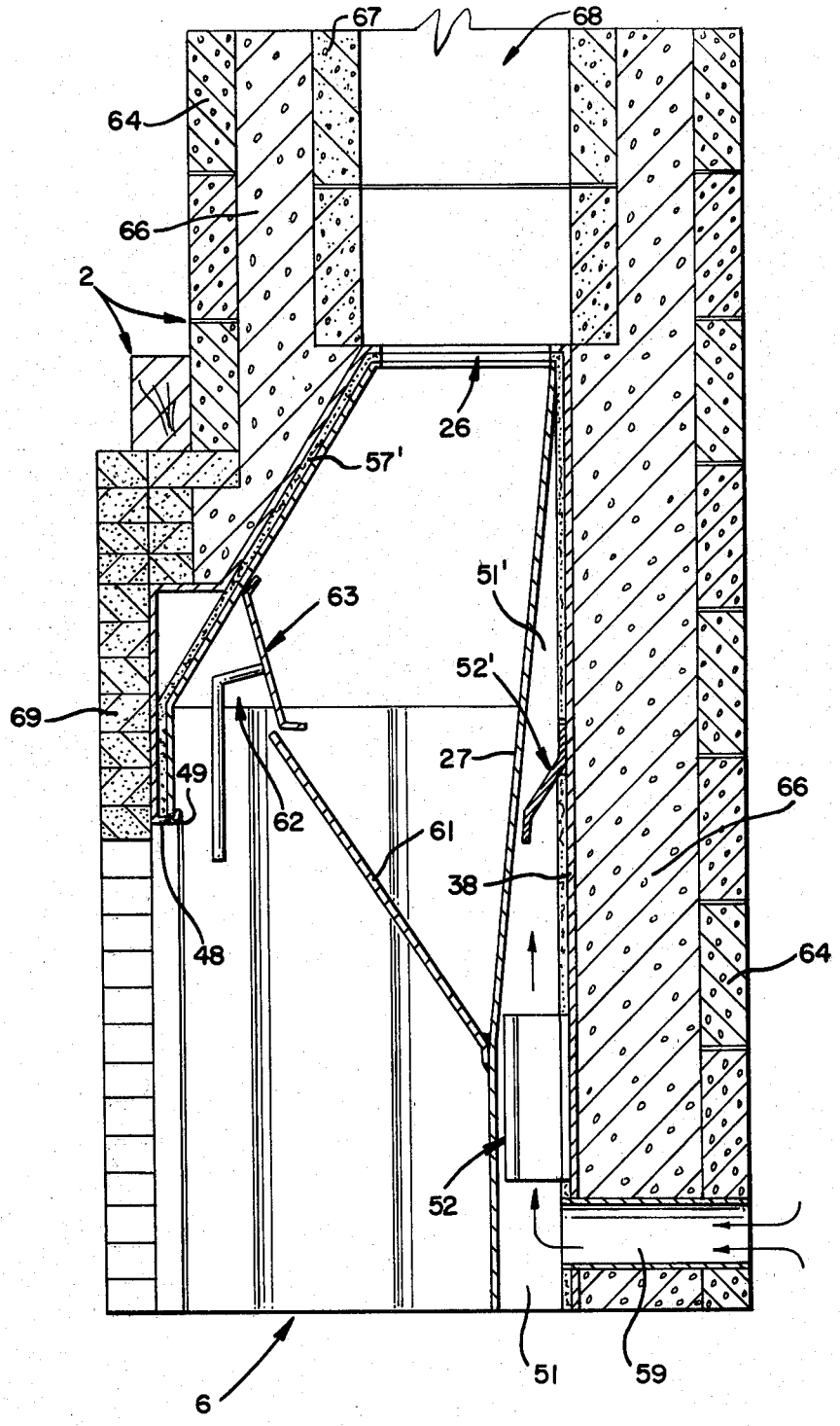
FIG. 5 is a vertical cross-sectional view taken in the plane indicated by the line 5—5 in FIG. 4.

In terms of greater detail, the fireplace structure incorporating a prefabricated firebox is illustrated generally in FIG. 4 and designated therein by numeral 2, and shown in greater detail in FIG. 1 in which there is shown an inner liner designated generally by the numeral 3, an outer liner designated generally by the numeral 4, the inner and outer liners 3 and 4 being assembled as illustrated in FIGS. 2 and 3 where the general assembly of both the inner and outer liners 3 and 4 is designated generally by the numeral 6, this general assembly then being surrounded by appropriate masonry as illustrated in FIG. 4 in perspective and in FIG. 5 in a vertical cross-sectional view.

Referring to FIG. 1, the inner liner 3 of the firebox comprises a lower section designated generally by the numeral 7 and including side jambs 8 and 9 joined at rear corners 12 by a rear wall 13. The lower portion 7 is preferably fabricated from twelve gauge sheet steel and is formed with a plurality of vertically extending ribs 14 which project outwardly from the jambs 8 and 9 and back wall 13 so as to stiffen these members and prevent their being deformed by heat. The lower edges 16 of the lower portion 7 are adapted to rest firmly on the hearth or inner hearth as it is sometimes called, this being the floor of the fireplace within the firebox. In some instances this hearth may be the top surface of the firebrick laid in mortar within the firebox to form the inner hearth, and in some instances the inner hearth may form an extension of the outer hearth which constitutes that area immediately in front of the fireplace opening.

The front or fireplace opening of the inner liner 3 is defined by the forward edges of jambs 8 and 9 and a top plate portion 17 integral with the jambs and extending transversely therebetween, the top edge 18 of the plate-like portion 17 being flush with the top edges 19 of jambs 8 and 9. The lower portion 7 is fabricated from heavy twelve gauge sheet steel and is welded around its upper edge to a pyramidal-like upper portion 21 likewise formed from heavy sheet steel in the order of twelve gauge steel and having its base edges welded integrally to the top edges of the lower portion 7 as illustrated. The side walls 22 and 23 of this unit are tapered as illustrated and complement the tapered front wall 24 to define a flu opening 26. The back wall 27 of the upper portion 21 is a continuation of the back wall 13 of the lower portion 7, these wall portions all being welded together to form one integral, rigid and hollow inner liner as depicted in FIG. 1. For purposes which will hereinafter be explained, the front edges of the side jambs 8 and 9 are provided with laterally projecting flanges 28 and 29 as shown.

The inner liner 3 depicted in FIG. 1 is adapted to be inserted into and to complement the outer liner 4, also depicted in FIG. 1, to form a composite firebox assembly. The outer liner 4 is conveniently fabricated from a lighter sheet metal such as twenty-six gauge galvanized sheet metal formed to provide side walls 31 and 32, and front wall 33, a mantle wall 34 and a breast wall 36 as shown. The front wall 33 is provided with a pair of apertures 37 for a purpose which will hereinafter be explained. Side walls 31 and 32 are joined at their rear edges by a rear wall 38 while the side walls 31, 32, rear wall 38 and breast wall 36 are all jointed by a top wall 39 having an aperture 41 formed therein through which the upper apex end portion of the inner liner 3 may project as illustrated in FIG. 2. The front wall 33 is also provided with a fireplace aperture designated generally by the numeral 42, the opening 42 being defined along its lateral sides by vertical front wall portions 43 and 44, each of which has a re-entrant flange portion 46 as shown in FIG. 3. Additionally, the upper edge portion 47 of the opening 42 is also provided with an inwardly extending flange portion 40 having a re-entrant portion 49 thereon.

With the inner and outer firebox liners 3 and 4 fabricated as illustrated, they are adapted to be telescoped one within the other as illustrated schematically in FIG. 1, and in full assembly in FIG. 2. To accomplish this end, the outer firebox liner 4 is dropped over the top of the inner firebox liner 3 until the lower edges of the side walls 31 and 32 of the outer liner 4 rest on the same surface on which the inner liner 3 is supported. In this position, the lower edge 48 of the front wall 17 of the inner liner 3 rests in the channel formed by flanges 48 and 49 defining the top of the opening in the outer firebox liner 4, while the outwardly extending flange members 28 and 29 of the inner firebox member lie lodged behind the re-entrant flanges 46 formed on the front wall portions 43 and 44 of the outer liner member as illustrated in FIG. 3. The upper truncated end portion of the inner liner 3 projects a small amount through the opening 41 in the top wall 39 of the outer liner 4 to thus capture and position and retain in position the inner liner with respect to the outer liner, and to provide a guide for the superpostion of the clay flue section as hereinafter described.

As illustrated in FIG. 3, when the inner and outer liner are in this position, the forwardly and laterally extending flange portions 28 and 29 of the inner liner are locked behind the re-entrant flanges 46 of the outer liner to thus stabilize the relationship between the inner and outer liner. Additionally, it will be noted that the side jambs 8 and 9 of the inner liner lie spaced from the side walls 31 and 32 of the outer liner in the same manner that the back wall 13 of the inner liner is spaced from the back wall 38 of the outer liner to provide a continuous chamber 51 between these inner and outer wall portions.

When the firebox thus constructed is installed in a fireplace structure, and a fire is lighted in the firebox, heat from the fire will be radiated to the walls 8, 9 and 13 of the inner liner. The inner liner will thus expand as it is heated and must be permitted to expand or "grow" without imposing destructive structural stresses on the outer liner 4 and through the outer liner 4 on surrounding masonry. To effectuate this end, as seen in FIGS. 2 and 3, there is provided in the space 51 between the inner and outer liners, a plurality of generally Z-shaped metallic baffles designated generally by the numeral 52 and including a transversely extending web portion 53 integral adjacent the inner liner with a flange 54 and integral adjacent the outer liner with a flange 56.

The baffles 52 as illustrated in FIG. 3 are arranged so that the flange portions 56 are appropriately spot-welded or otherwise secured to the outer liner 4, while the opposite flange 54 adjacent the inner liner merely abuts the inner liner but is not fastened to it. In the interest of clarity in this regard, the inner flanges 54 have been illustrated spaced a small distance from the associated walls of the inner liner to emphasize the fact that the flanges 54 are not integrally or rigidly attached to the inner liner. It will also be seen that the baffles 52 include a web 53 that is angularly disposed between the walls of the inner and outer liners so that when force is applied in a transverse direction against the flanges 54 by the outwardly expanding inner liner 3, such force will effect lateral displacement of the inner flanges 54 and the associated webs 53 in a direction to accommodate expansion of the inner liner.

In FIG. 3 all of the baffles 52 are illustrated as being vertically arranged in the space 51. It has been found advantageous to utilize similar baffles in the space 51' which is provided between the back wall 38 of the outer liner and the back wall 27 of the inner liner as illustrated at 52'.

Referring again to FIG. 3, it will be apparent that as the inner liner 3 is heated to a high temperature by a fire lighted in the fireplace, the walls of the inner liner will radiate heat outwardly toward the outer liner. To prevent or at least minimize the effect of such radiated heat through the space 51 between the two liners, the inside surface of the outer liner is lined or covered with an appropriate layer of insulation 57 the surface 58 of which next adjacent the inner liner is preferably reflective to radiated heat impinging upon it so that it reflects heat back toward the inner liner 3. Such insulation has the effect of maintaining the outer liner 4 at a much lower temperature than the inner liner to minimize the expansion of the outer liner as the result of radiated heat from the inner liner.

In addition, as stated previously, the outer liner is fabricated from relatively light gauge galvanized sheet metal which does not have sufficient strength to dominate the surrounding masonry structure even if it is heated to a high temperature. But even should this occur, i.e., that the outer liner should be heated to a high temperature, it will be noted that because of the relatively flexible interposition of the baffles 52 between the inner and outer liner, and the relative strength of the masonry surrounding the outer liner, the outer liner will be permitted to grow inwardly toward the inner liner rather than outwardly in a destructive manner against the surrounding masonry.

To further insure that no destructive stresses are imposed on the masonry surrounding the outer liner, and to increase the efficiency of the fireplace with respect to heating the room into which it opens, the space 51 between the rear wall 38 of the outer liner and the rear wall 13 of the inner liner is connected by an appropriate conduit 59 with the outside atmosphere and serves as a passage for fresh outside air into the chamber 51 surrounding the inner firebox. Such outside air is heated by convection by the hot surfaces of the inner liner and fills the chamber 51 on three sides of the inner liner and rises upwardly into the chamber 51' behind the back wall and around the sides of the inner liner and is discharged into the room into which the fireplace opens through the openings 37 in the front wall of the outer liner. Although it has not been illustrated in the drawings, it will be obvious that where necessary or desirable an appropriate motor-driven fan or blower may be installed so as to force air through the chambers 51 and 51' and out the openings 37.

Referring to FIG. 5, it will be seen that the upper front wall 24 of the inner liner lies substantially closer to the outer wall 36 of the outer liner than other portions of the structure. To insure that the outer liner is not heated excessively in this area, the space between these two wall portions is packed with appropriate thermal insulation 57' which may be of the same type as is utilized in other areas of the firebox, or which may be of a type having a higher thermal insulation rating. Within the inner firebox, as illustrated in FIG. 5, there is provided a baffle 61 that extends completely across the inner liner and stops short of the front wall 24 thereof to provide a throat 62 through which the products of combustion pass upwardly to the flue discharge opening 26 of the inner liner. An appropriate damper mechanism designated generally by the numeral 63 controls the degree of draft that is permitted to flow through the fireplace.

I have found that the construction of the firebox disclosed above is of sufficient strength to to be used the inner wall of, for example, a concrete pouring form. The outer wall of the form may constitute prefabricated masonry units 64 appropriately mortared together as shown. Between the masonry units and the side walls 31, 32 and back wall 38 of the outer liner 4 is poured a body of concrete 66. As illustrated in FIG. 5, the concrete can be extended upwardly to surround the flue tubes 67, the interior 68 of which form a continuous passageway with the interior of the inner liner and flue opening 26 so as to carry products of combustion out of the building in which the fireplace structure is constructed. The front wall of the firebox may be decorated by appropriate masonry 69 which in the lower region surrounding the opening of the fireplace may be appropriate decorative-type brick or stone, and which in the upper reaches may be prefabricated masonry units 64 as previously described. In any event, the space between such masonry products 64 and 69 may be filled with concrete 66 as previously described so as to immobilize the entire firebox assembly within non-combustible masonry materials.

I have found that a fireplace structure as described herein may be easily constructed on the job site without the use of expensive and time-consuming hoisting equipment because major portions of the fireplace structure are prefabricated in smaller units that may be easily carried by one or two men so that the fireplace structure in effect is modular in its construction, thus decreasing its cost and facilitating its assembly.

Having thus described the invention, what it thought to be novel and sought to be protected by letters patent of the United States is as follows:

I claim:

1. A prefabricated metallic firebox for a fireplace structure comprising:

an inner metallic liner fabricated from relatively heavy gauge metal, said inner liner having front, rear and side walls and including an opening in said front wall defining the fireplace opening and an opening at the top of said front, rear and side walls constituting a flue opening for passage of products of combustion from said firebox;

an outer metallic liner having front, rear and side walls corresponding to the front, rear and side walls of said inner metallic liner, the corresponding walls of said inner and outer metallic liners being spaced apart to define a passageway therebetween for the passage of air therethrough, said outer metallic liner being fabricated from sheet metal which is relatively light gauge with respect to the thickness of said inner liner and which has a thermal expansion strength insufficient to damage surrounding masonry structures when heated; and a plurality of Z-shaped spacer baffles interposed between said corresponding walls of said inner and outer liners, each said baffle including a web portion and a flange on each opposite end of said web, said web portions extending transversely between said walls and being angularly disposed with respect to said walls, each said baffle being fixed by means of a corresponding flange to said outer liner and impinging loosely against said inner liner and being flexible whereby when said inner liner is heated outward thermal expansion of said inner liner is accommodated by transverse displacement of said spacer baffles and accompanying lateral displacement of the flanges impinging against said inner liner, without causing an outward displacement of said outer liner, said inner liner being free to flex inwardly when heated to prevent damage to surrounding masonry structure.

2. The combination according to claim 1, in which a layer of thermal insulation is provided on the inner surface of said outer liner to insulate the outer liner against heat from the inner liner.

3. The combination according to claim 1, further including means for conducting cooling air into said passageway between said inner and outer liners, whereby said outer liner is maintained cooler than said inner liner.

* * * * *